US005159911A

United States Patent [19]

Williams et al.

[11] Patent Number: 5,159,911

[45] Date of Patent: Nov. 3, 1992

[54] HOT START OPEN NOZZLE FUEL INJECTION SYSTEMS

[75] Inventors: John C. Williams, Columbus; Kevin W. Westerson, Nashville; George L. Muntean, Columbus, all of Ind.; Thomas W. Sullivan, Blue Springs, Mo.

[73] Assignee: Cummins Engine Company, Inc., Columbus, Ind.

[21] Appl. No.: 718,981

[22] Filed: Jun. 21, 1991

[51] Int. Cl.[5] ..... F02M 55/00

[52] U.S. Cl. ..... 123/467; 123/456

[58] Field of Search ..... 123/514, 198 DB, 467, 123/447, 456

[56] References Cited

U.S. PATENT DOCUMENTS

| | | | |
|---|---|---|---|
| 3,490,425 | 1/1970 | Bassot et al. | 123/447 |
| 4,064,855 | 12/1977 | Johnson | 123/467 |
| 4,380,976 | 4/1983 | Bottiglieri | 123/198 DB |
| 4,485,789 | 12/1984 | Walter et al. | 123/467 |
| 4,532,895 | 8/1985 | Kueny | 123/447 |
| 4,782,808 | 11/1988 | Bostick et al. | 123/467 |
| 4,811,711 | 3/1989 | Stumpp et al. | 123/198 DB |
| 4,911,127 | 3/1990 | Perr | 123/447 |

FOREIGN PATENT DOCUMENTS

| | | | |
|---|---|---|---|
| 0091363 | 5/1983 | Japan | 123/514 |
| 0016162 | 1/1988 | Japan | 123/514 |
| 0238169 | 1/1990 | Japan | 123/467 |
| 610248 | 10/1948 | United Kingdom | 123/514 |
| 2134987 | 8/1984 | United Kingdom | 123/514 |

*Primary Examiner*—E. Rollins Cross
*Assistant Examiner*—Thomas N. Moulis
*Attorney, Agent, or Firm*—Sixbey, Friedman, Leedom & Ferguson

[57] ABSTRACT

A fuel leakage prevention system for preventing undesired leakage of fuel into the combustion chambers of an internal combustion engine equipped with a pressure/-time, cam actuated unit fuel injection system. The system includes a main housing containing an evacuatable chamber adapted to be connected by a first fluid conduit to a source of sub-atmospheric pressure by a check valve and manual shut off valve. The evacuatable chamber is also adapted to be fluidically connected to a common rail supplying fuel to the injectors by a solenoid controlled valve which is open during engine shutdown and closed during engine operation whereby fuel is withdrawn from the injectors by the vacuum upon engine shutdown.

29 Claims, 5 Drawing Sheets

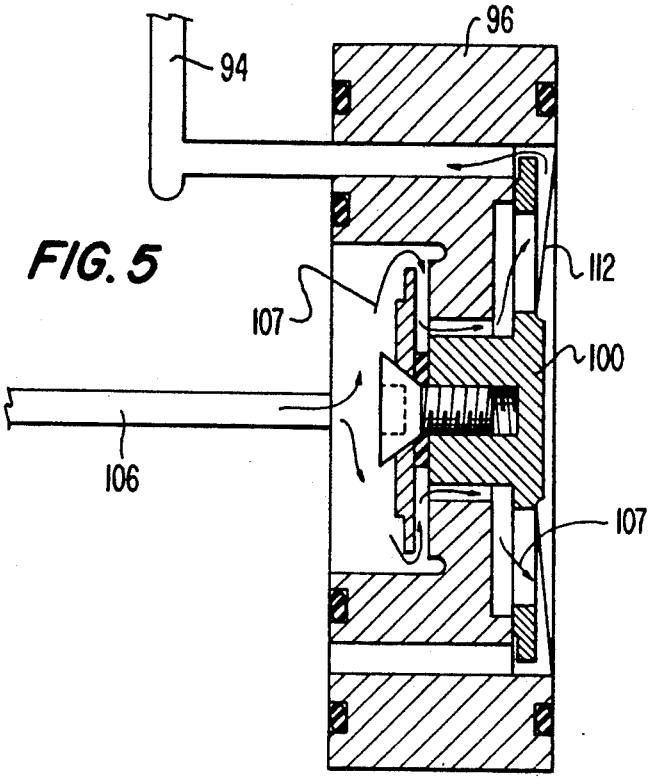
FIG. 5
FIG. 8
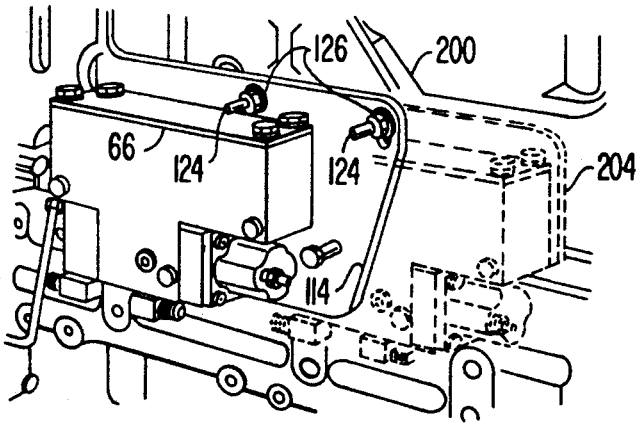
FIG. 9
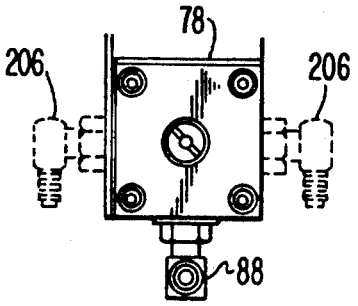

HOT START OPEN NOZZLE FUEL INJECTION SYSTEMS

TECHNICAL FIELD

This invention relates to a system for preventing undesired fuel migration into the combustion chambers of a shut down internal combustion engine equipped with open nozzle, cam operated unit fuel injectors.

BACKGROUND ART

Designers of fuel injection systems for internal combustion engines are continuously seeking ways to achieve maximum performance capability while minimizing manufacturing, repair and replacement costs. These objectives are particularly difficult to achieve in the design of fuel injection systems for internal combustion engines of the compression ignition (diesel) type. For example, efficient combustion and low pollution operation of diesel engines requires extremely accurate control over the quantity and timing of fuel injection at very high pressure, i.e. 15,000–20,000 psi and higher. Systems adequate to achieve these objectives are typically complicated and require extremely close manufacturing tolerances. Obviously, these design complications and requirements translate into very high manufacturing and replacement costs.

The assignee of this application, Cummins Engine Company, Inc., has pioneered in the development of a relatively simple fuel injection system for compression ignition engines that optimizes desirable performance objectives but avoids the high costs associated with more complicated systems. This system is known as a pressure/time unit injector system and is disclosed in U.S. Pat. Nos. 3,351,288 and 3,544,008. Essentially the system includes a separate cam operated unit injector for each engine cylinder and a single supply line (common rail) for supplying fuel to all of the unit injectors. Because fuel is metered into each injector through a separate feed orifice, the time during which each feed orifice is open and the pressure within the common rail can be relied upon to control the quantity of fuel metered for injection during each injection cycle. Of particular importance in achieving reduced cost in the Cummins system is the absence of a pressure operated tip valve to form a "closed nozzle" injector. Prior art injector designs, such as illustrated in U.S. Pat. No. 4,092,964, often require a closed nozzle for accurate metering and, thus, the open nozzle Cummins design enjoys a cost advantage because no pressure operated tip valve is required.

One of the problems associated with ignition compression engines equipped with the Cummins pressure/-time, open nozzle injection system has been the tendency to resist start-up shortly after being shut down, for example three to twenty minutes following shut down. This characteristic is known as the hot start problem. The severity of the problem is dependent primarily on starting system capability, engine temperature, type of fuel and compression ratio. An associated problem can be excessive smoke and noise even if start up is successfully achieved.

The severity of the hot start problem can range from the engine not cranking through the first compression stroke until the engine has cooled for several minutes, to the engine cranking normally and starting after hesitating slightly on the first compression stroke. Many vehicle operators have a tendency to let off the starter switch when the engine first hesitates and in most cases, when the starter switch is "bumped" the second time, the engine will crank through and start. However, certain operators have experienced significant hot start problems with vehicles equipped with Cummins engines. These operators are typically those who use their vehicles for short pickup and delivery applications with frequent shut downs and startups. A higher incidence of hot start problems occur in colder climates where winter fuel blends of No. 1 and No. 2 diesel fuel are used.

Fuel injectors having closed nozzle tip valves have inherently greater ability to control fuel leakage into the combustion chambers of the engine upon shut down. Such leakage is known to be disadvantageous in certain types of non-Cummins type fuel injection systems. For example, the patent to Bostick et al. (U.S. Pat. No. 4,782,808) discloses a fuel injection system employing solenoid controlled, closed nozzle injectors wherein pressure is relieved upon engine shut down in the fuel supply line leading to the injectors. This pressure relief is designed to prevent fuel leakage through the injectors and into the cylinders, col. 3, lines 57–58. Additionally, this reference teaches that the pressure in the fuel supply line can be decreased after engine shut down by expanding the volume of the fuel supply line by using, for example, a bellows configuration, col. 5, lines 14–16. The purpose of the Bostick et al. system is disclosed to be the reduction in the tendency for carbon and varnish to form in the injectors due to heat build up immediately after engine shut down.

The type of fuel injection system disclosed in the Bostick et al. patent is typically used on gasoline, spark ignition engines which are typified by far lower injection pressures. This lower pressure allows the use of only a single fuel pump for creating the requisite injection pressure for all of the engine cylinders. In compression ignition engines the need for much higher injection pressures necessitates the use of individual cam operated unit injectors positioned adjacent each engine cylinder to avoid the negative effects of pressure waves that would otherwise arise if fuel were supplied at the requisite injection pressure through relatively long conduits.

The Bostick et al. type injectors also employ a solenoid actuated tip valve to control injection timing and quantity. Clearly, injectors of this type are quite different in structure and function from injectors of the type disclosed in the Cummins '288 and '008 patents.

The patent to Knapp et al. (U.S. Pat. No. 4,227,501) discloses a system to allow fuel in the injector fuel supply line to return to the fuel tank when the engine is shut off, thereby preventing evaporation of the fuel in the supply line, which can lead to starting difficulties (vapor lock). Again this patent shows a system suitable for injection of gasoline and fails even to disclose injection directly into a combustion chamber but shows instead injection into the intake passage upstream of the intake valve.

Other types of vapor lock prevention systems have been disclosed including a system (Japanese Patent Document 57-200663A to Yamazaki) which uses a solenoid valve between the fuel supply line and a return line wherein the valve is actuated under certain conditions upon engine shutdown. Again, this patent fails specifically to suggest application of this concept to cam actuated unit injectors for compression ignition type fuel injector systems.

Other examples of systems for removing fuel from injector supply lines are disclosed in the patents to Ulrich (U.S. Pat. No. 4,257,375), Gmelin et al. (U.S. Pat. No. 4,383,513) and Maisch et al. (U.S. Pat. No. 4,530,329).

DISCLOSURE OF THE INVENTION

A primary object of this invention is to overcome the deficiencies of the prior art as discussed above by providing a fuel leakage prevention system for eliminating undesired leakage of fuel into the combustion chamber of a multi-cylinder internal combustion engine from a plurality of corresponding fuel injectors supplied with fuel by a common rail connected to the fuel injectors.

Yet another object of the subject invention is to provide a fuel leakage prevention system adapted to correct hot start problems associated with an internal combustion engine having cam operated unit fuel injectors supplied with fuel through a common rail wherein the system is designed to withdraw an adequate amount of fuel from the common rail to prevent fuel from entering the engine cylinders after shutdown.

A more specific object of the subject invention is to provide a system for preventing undesired leakage of fuel into the combustion chambers of a multi-cylinder internal combustion engine provided with open nozzle, cam actuated unit injectors.

A still more specific object of the subject invention is to provide a fuel leakage prevention system including a main housing containing an evacuatable chamber and a vacuum applying means connected with the evacuatable chamber and fluidically connected to a common rail supplying a plurality of fuel injectors wherein a valve is provided for fluidically isolating the common rail from the evacuatable chamber during engine operation and for causing the common rail to be subjected to a sub-atmospheric pressure during engine shutdown.

A still more specific object of the subject invention is to provide a fuel leakage prevention system of the type described including a vacuum forming means fluidically connected with the evacuatable chamber and adapted to be fluidically connected with a source of sub-atmospheric pressure during engine operation combined with a second valve in the form of a check valve for isolating the evacuatable chamber from the source of sub-atmospheric pressure whenever the pressure in the evacuatable chamber is below that of the sub-atmospheric pressure source.

Another object of the subject invention is to provide a fuel injection system of the type described above for injecting fuel periodically into the combustion chambers of a multi-cylinder internal combustion engine including a fuel pump for forming a source of fuel under pressure, a common rail for supplying fuel under pressure from the fuel pump to each of the engine cylinders during engine operation, and a plurality of fuel injectors connected with the common rail for injecting fuel from the common rail into corresponding cylinders of the engine. Each of the fuel injectors includes an injection orifice from which fuel enters into the corresponding engine cylinder wherein at least one of the engine combustion cylinders remains fluidically connected with the common rail during engine shutdown through a corresponding open injection orifice and wherein vacuum applying means are provided for preventing migration of fuel into the engine cylinders through the open injection orifice during engine shutdown by reducing the fluidic pressure within the common rail sufficiently to prevent fuel from migrating through the open injection orifice.

Another object of the subject invention is to provide a fuel injection system for an internal combustion engine including a fuel injector having a body containing at least one injector orifice and an injection chamber into which fuel may be metered and from which the metered fuel may be expelled for periodic injection into the combustion chamber of the internal combustion engine through the associated injection orifice. A vacuum forming means is provided for forming a sub-atmospheric pressure and a vacuum applying means is provided for preventing migration of the supplied fuel from the injection chamber into the combustion chamber during shutdown of the internal combustion engine by fluidically connecting the vacuum forming means with the combustion chamber during engine shutdown.

Yet another object of the subject invention is to provide a system of the type described above including a fuel pump which is capable of providing fuel at a controlled pressure to the common rail while also creating a source of sub-atmospheric pressure and wherein the vacuum forming means includes a first fluid conduit fluidically connected at one end to the evacuatable chamber and adapted to be fluidically connected at the other end to the sub-atmospheric pressure forming portion of the fuel pump.

Still another object of the subject invention is the provision of a fuel system of the type described above wherein the vacuum applying means includes a second fluid conduit fluidically connected at one end to the evacuatable chamber and adapted to be fluidically connected at the other end to the common rail.

Still another object o the subject invention is to provide a fuel system of the type described including mounting hardware for retrofitting the system on an existing internal combustion engine subject to start-up problems associated with undesired fuel leakage into the combustion chambers and to provide adapter fittings for connecting the first and second fluid conduits to the sub-atmospheric fluid pressure portion of the fuel pump and the common rail, respectively.

A more specific object of the subject invention is to provide a fuel system for retrofitting a pre-existing internal combustion engine of the type described above wherein the engine to be retrofitted includes an intake manifold with a pre-existing array of bolt holes and wherein the hardware includes a mounting bracket having a first array of mounting holes corresponding to the existing array of intake manifold holes and further wherein the mounting bracket includes a second array of holes for receiving fasteners for mounting the main housing containing the evacuatable chamber on the bracket such that the first and second arrays are offset and each array is internally symmetric to allow the bracket to be mounted on the engine intake manifold in one of two reverse positions and to allow the main housing to be mounted in one of two offset positions using the bracket.

A still further specific object of the subject invention is to provide a fuel system of the type described wherein the first valve includes a solenoid operator for closing the first valve upon receipt of electrical energization to isolate the evacuatable chamber fluidically from the common rail and further including a spring bias for returning the valve to an open condition upon loss of electrical energization thereby fluidically connecting the evacuatable chamber to the common rail of the system. By this arrangement, desired operation of the system occurs if the solenoid is energized during engine operation and de-energized upon engine shutdown.

A still further object of the subject invention is to provide a fuel system of the type described wherein an additional shutoff valve for shutting off the fluid connection between the evacuatable chamber and the source of sub-atmospheric pressure. The shutoff valve may be manually operated and may be configured to be mounted in a plurality of different rotational positions relative to the main housing to provide various configurations of the fluid conduit relative to the main housing to adapt the system to a variety of different engine environments.

The above objects may be achieved by the provision of a hot start kit for retrofitting existing internal combustion engines employing an open nozzle, pressure/-time unit fuel injection system including a main housing containing an evacuatable chamber. The kit includes a first valve and associated fluid conduit for fluidically connecting the evacuatable chamber to the common rail of the fuel injection system. Also provided are a check valve and manually operated valve in series with a second fluid conduit for fluidically connecting the evacuatable chamber to a sub-atmospheric pressure created by the fuel pump of the internal combustion engine. The kit still further includes a bracket mounting structure, fluid fitting adapters and electrical connections suitable for operatively mounting the system on an internal combustion engine.

Other and more specific objects of the invention may be understood from an examination of the following Brief Description of the Drawings and Best Mode for Carrying Out the Invention.

BRIEF DESCRIPTION OF THE DRAWINGS

FIG. 5 is a cross sectional view of the valve actuator housing used in the system illustrated in FIG. 4 wherein the valve element has assumed the position it takes following engine shut down.

FIG. 8 is a perspective view of the hot start kit shown in FIG. 7 mounted in alternative positions on an internal combustion engine.

FIG. 9 is a elevational view of the manual shutdown valve showing how the manual shutdown valve housing may be rotated into alternative positions.

BEST MODE FOR CARRYING OUT THE INVENTION

Figure 1A:
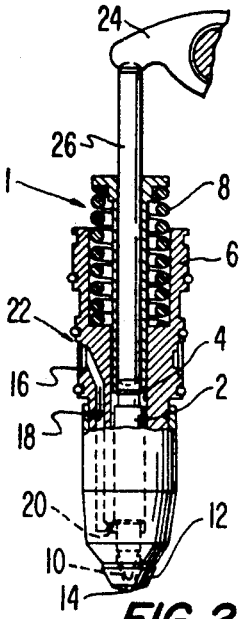
FIG. 1(a) PRIOR ART
FIG. 1*a* is partially broken away cross-sectional view of a prior art cam operated, open nozzle pressure/time injector undergoing a metering operation.

For a clear understanding of the subject invention, reference is initially made to FIG. 1*a* which discloses an open nozzle, cam operated unit injector 1 of the type typically employed in a fuel injection system which relies on pressure/time principles. Such injectors achieve desired fuel quantity metering for each injection cycle in accordance with the principles described in detail in U.S. Pat. Nos. 3,351,288 to Perr and 3,544,008 to Reiners et al. In FIG. 1*a*, the injector is shown in its metering mode of operation wherein the injector plunger 2, mounted within a central cavity 4 of the injector body 6, has been retracted under the bias of return spring 8. In this position of the injector plunger 2, a injection chamber 10 is formed at the lower end of central cavity 4 between injector plunger 2 and the lowermost end of the injector body. A nozzle 12 at the lower end of body 6 contains one or more injection orifices 14 fluidically connecting the injection chamber 10 with the combustion chamber (not illustrated) associated with the injector.

When the injector plunger is in the retracted position illustrated in FIG. 1*a*, fuel supplied from a common rail (not illustrated) enters the injector body at inlet port 16, travels through a feed passage 18 and is metered into the injection chamber 10 through a metering orifice 20. The path of the fuel is shown by arrows 22.

Figure 1B:
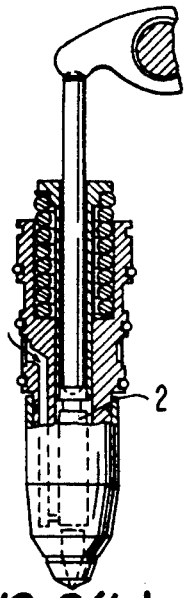
FIG. 1(b) PRIOR ART
FIG. 1*b* is a partially broken away cross-sectional view of the injector of FIG. 1*a* after an injection event.

Inward movement of the injector plunger 2 is caused by a cam (not illustrated) which is rotationally synchronized for movement with the combustion chamber piston (not illustrated) through a drive train including rocker arm 24 and link 26. When fully advanced, the injector plunger 2 assumes the position illustrated in FIG. 1*b* to cause the lower end of the plunger to collapse the injection chamber 10 and expel the fuel which has been metered therein into the corresponding combustion chamber. When in the position illustrated in Fib. 1*b*, no fluid communication exists between the common rail supply in the injector and the corresponding combustion chamber. However, as will be explained more fully hereinbelow, upon engine shutdown, not all of the injectors will assume the position illustrated in FIG. 1*b* because at least one or more may be in the metering phase of operation as illustrated in FIG. 1*a*.

Figure 2A:
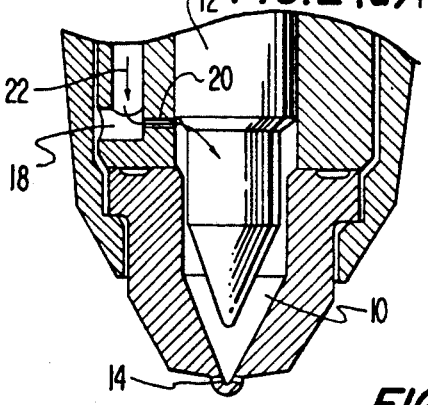
FIG. 2(a) PRIOR ART
FIG. 2*a* is an enlarged broken away cross-sectional view of the nozzle of the injector shown in FIG. 1 wherein the injector plunger is retracted to allow metering of fuel.

Now referring more specifically to the enlarged cross-sectional cutaway view of FIG. 2*a*, the injector plunger 2 is illustrated in its retracted position whereby fuel supplied through a common rail may be metered into injection chamber 10 through feed orifice 20 for subsequent discharge through injection orifices 14. In enlarged view 2*b*, the injector plunger 2 has been fully advanced to collapse the injection chamber and thus block communication between passage 18 and the corresponding combustion chamber serviced by the injector.

Figure 3:
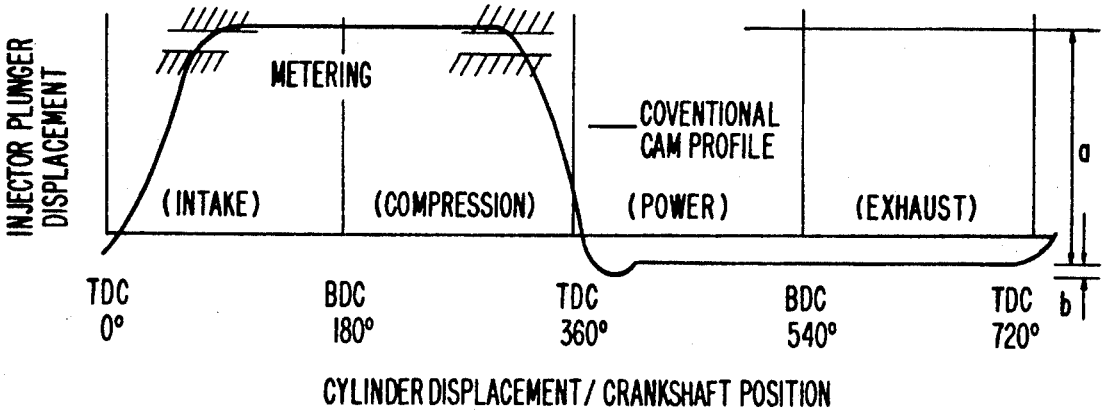
FIG. 3 is a graph disclosing the engine cylinder displacement/crankshaft position versus the injector plunger displacement occurring in a engine equipped with a conventional cam profile for operating the injector illustrated in FIGS. 1 and 2.

Now referring to FIG. 3, a graph is illustrated showing the relationship of the combustion cylinder piston displacement and corresponding crankshaft rotational position in relationship to the displacement of the injector plunger serving the corresponding engine cylinder.

In particular, the abscissa of the graph shows the four strokes of the engine cylinder piston starting with the intake stroke and the corresponding rotational position of the crankshaft through one complete four stroke cycle. The displacement of the corresponding injector plunger is illustrated along the ordinate. Thus, it can be seen that the plunger is moved into the position illustrated in FIGS. 1*a* and 2*a* approximately half way through the intake stroke and remains in this position until close to the end of the compression stroke at which point the injector plunger is rapidly advanced to force the metered fuel through the injection orifices 14. FIG. 3 shows that the plunger is subjected to a slight overtravel to produce a sharp end of injection.

From a consideration of the cam profile, it should be apparent that in a typical internal combustion engine containing four to eight cylinders, upon engine shutdown, the injector plunger of at least one, and probably more, cylinders will reside in the position illustrated in FIGS. 1*a* and 2*a*. As noted above, for injectors assuming the condition of FIG. 1*a*, the combustion chamber would be in substantially open fluid communication with the injector chamber 10 as well as the common rail supplying fuel to the injector through feed orifice 20 and passage 18.

Figure 2B:
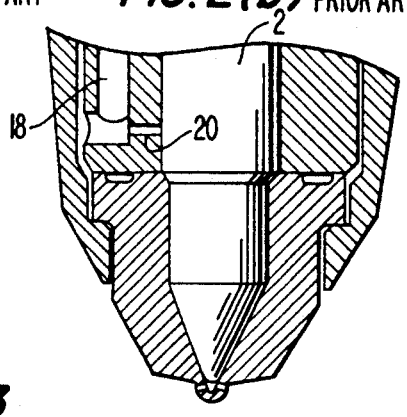
FIG. 2(b) PRIOR ART
FIG. 2*b* is an enlarged broken away view of the nozzle of the injector shown in FIG. 1*b* wherein the injector plunger is advanced to the position occupied at the end of injection.

In situations where an internal combustion engine is equipped with injectors of the type illustrated in FIGS. 1 and 2, problems can arise as a result of attempting to restart an engine fairly quickly after the engine has been shutdown, i.e., in the period three to twenty minutes following shutdown. In particular, it has been discovered that any fuel remaining in the injection chamber 10 and/or fuel available in passage 18 and the common rail communicating therewith may have a tendency to migrate into the combustion chamber through open injection orifices 14 upon engine shutdown due to thermal expansion of the fuel and due to reduced pressure of the gases contained in the combustion chamber of the corresponding engine cylinder. Upon initial start-up of the engine, the fuel, which has migrated into the combustion chamber, will have effectively increased the compression ratio and/or may be inclined to ignite prematurely because the cylinder walls/piston head may remain sufficiently warm to induce such pre-ignition. The output torque of a starting motor may not be adequate to handle the effectively increased compression ratio or to overcome the force generated by such pre-ignition, thereby requiring the starter motor to be "bumped" or in extreme cases requiring the engine operator to delay the start up until the engine has cooled sufficiently to avoid pre-ignition. As can be understood, when fuels having a lower than conventional flash point are used, such as in colder environments, the start up of a recently shut down engine may be difficult. Migration of fuel may also contribute to excessive smoke in the engine exhaust and to injector carboning which leads to decreased engine performance.

Figure 4:
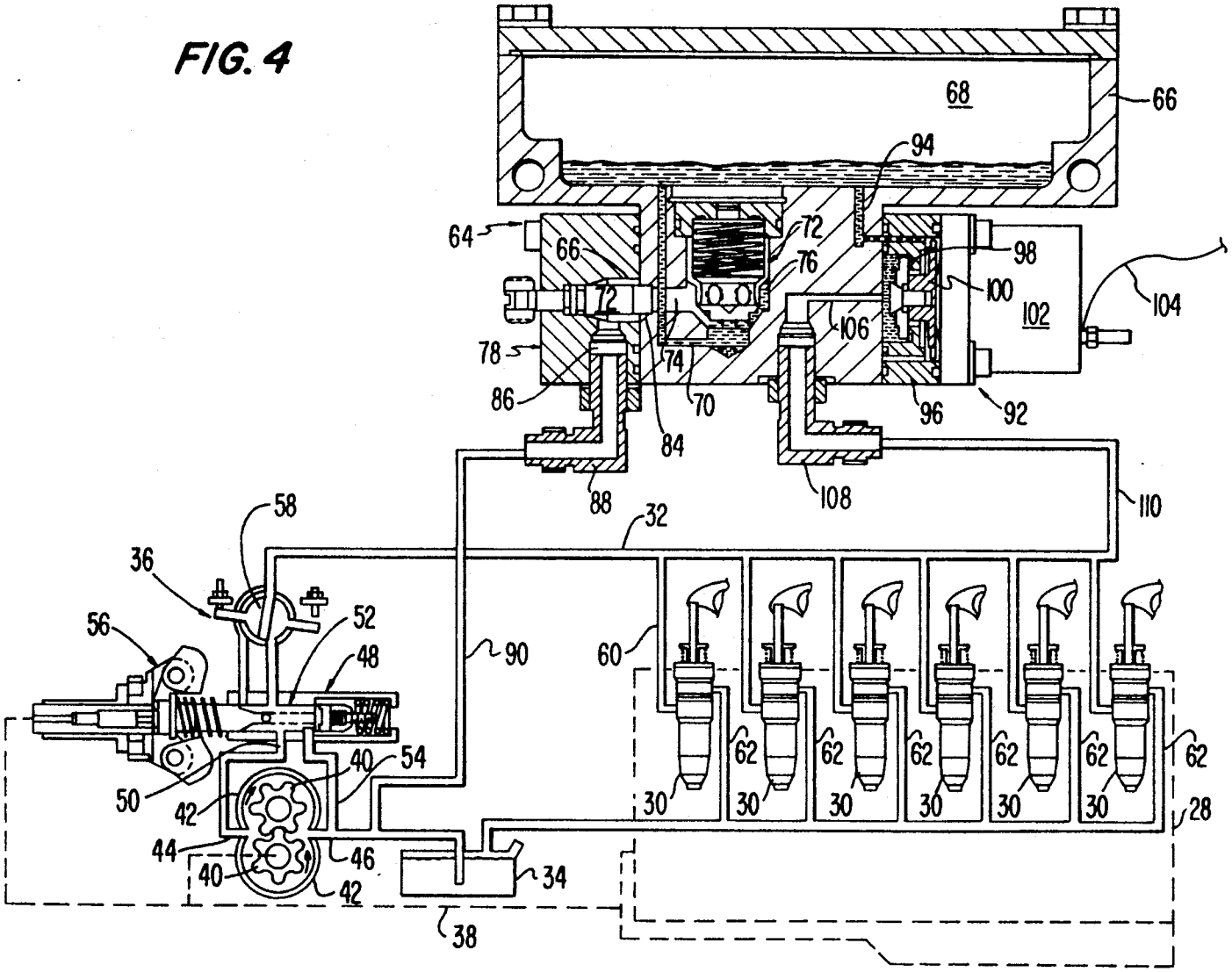
FIG. 4 is a schematic illustration of an internal combustion engine retrofitted with a hot start fuel injection system embodying the subject invention in the form which the system takes during engine operation.

A solution to these problems is brought about in accordance with the subject invention by the system illustrated in FIG. 4. In particular, this figure illustrates schematically an internal combustion engine 28, shown in dashed lines, provided with a Cummins-type open nozzle, cam actuated, pressure/time fuel injection system. In particular, the engine is provided with six cam actuated unit injectors 30 of the type illustrated in FIGS. 1 and 2. Fuel is applied to the injector via a common rail 32. Fuel from a fuel tank 34 is supplied to the common rail via a fuel pump assembly 36 which is mechanically driven by the crankshaft of the internal combustion engine through a positive drive train 38 which is typically a gear train mounted at one end of the engine. The fuel pump assembly 36 includes a pair of pump gears 40 of conventional design driven by the mechanical drive train 38 in the direction illustrated by arrows 42 to create a positive pressure at 44 and a sub-atmospheric suction pressure at 46. A pressure regulator 48 is included as part of the fuel pump assembly and includes an input 50 connected fluidically with the pressure side of the gear pump. A spool valve 52 and a spill return line 54 are organized in a known manner to operate as a pressure regulator. To make the pressure regulation speed sensitive, a flyweight inertial governor 56 is provided and driven by mechanical drive train 38 to supply rotational drive to the governor.

The output from the pressure regulator is supplied to common rail 32 via a throttling valve 58 operated by a throttle control (not illustrated) responding to either automatic or manual controls for operating the engine. As is shown in FIG. 4, each injector 30 is fluidically connected with the common rail 32 via a feed line 60 and excess fuel supplied to the injector is returned to the fuel tank 34 via drain lines 62.

To avoid the shortcomings of the prior art in which recently shut down engines of the type illustrated in FIG. 4 can be easily restarted, a fuel leakage prevention system is provided as generally indicated by arrow 64. In particular, the system includes a main housing 66 containing an evacuatable chamber 68 and includes a fluid passageway between the chamber and a portion of the fuel pump assembly which creates a sub-atmospheric pressure. In particular, the passageway includes first housing passage 70 communicating with a check valve 72. A receiving cavity 76 is provided in main housing 66 for check valve 72 which is arranged to cut off the passageway whenever the pressure within evacuatable chamber 68 falls sufficiently low relative to the sub-atmospheric pressure created by the suction side 46 of the fuel pump to cause the check valve to move to its closed position. A second housing passage 74 communicates with the check valve receiving cavity 76. The passageway further includes a manual shutoff valve assembly 78 including an internal passage 80 in which is positioned a manually operable valve element 82 which may be advanced into engagement with a valve seat 84 formed in main housing 66 at the exit end of second housing passage 74. A radial passage 86 intersects with internal passage 80 for connection via an L-shaped fitting 88 with a fluid conduit 90 extending from the manual shut off assembly to the sub-atmospheric pressure creating portion (suction side) 46 of the fuel pump. Upon engine start up, the sub-atmospheric pressure created by the fuel pump assembly 36 will open the check valve 72 as soon as the vacuum reaches 1 inch HG. Evacuatable chamber 68 will store the maximum vacuum established by the fuel pump. Upon engine shutdown the sub-atmospheric pressure created by the fuel pump naturally tends to rise which causes check valve 72 to close in order to trap the vacuum within chamber 68.

Thus, it can be seen that passage 70, check valve 72, passage 74, manual shutoff valve assembly 78, and fluid conduit 90, in combination, form a vacuum forming means. The purpose of manual shut off assembly 78 is to allow the system to be deactivated in case of the failure of any of its components.

To reduce the pressure in common rail 32 upon engine shutdown, the evacuatable chamber 68 is fluidically connected with the common rail 32 via a series of passageways and a solenoid operated valve 92. In particular, a third housing passage 94 is connected at one end to chamber 68 and at the other end to valve 92 including an actuator housing 96 containing a valve seat and a spring biased valve element assembly 100 which is normally opened but is moved to its closed position whenever the solenoid 102 is energized. As illustrated in FIG. 4, the solenoid of valve 92 is energized via electrical conductor 104 from the engine electrical system. For example, the energization signal may be provided on conductor 104 when the starting key is turned on and may be removed when the starting key is turned off. When the solenoid operated valve 92 is opened (engine shut down), vacuum pressure is applied to rail 32 via a fourth housing passage 106, fitting 108 and fluid conduit 110. Evacuatable chamber 68 may have a volume of approximately 11 cubic inches. In a typical installation, the system is designed to extract approximately 10–55 cc of fuel from the common rail.

Referring now to FIG. 5, the condition of valve element assembly 100 is illustrated in the position it assumes upon engine shutdown. In particular, solenoid 102 has been de-energized, causing valve element 100, under the bias of spring 112 to move to its open position. In this position, the vacuum pressure of chamber 68 is applied to common rail 32 which in turn communicates with the various injectors through lines 60. Should any of the injectors reside in the position illustrated in FIG. 2*a*, the corresponding injection chamber will be subjected to a negative pressure to extract fuel therefrom to prevent migration of the fuel into the corresponding injection chamber. Arrows 107 illustrate the flow of fuel through actuator housing 96.

Figure 6:
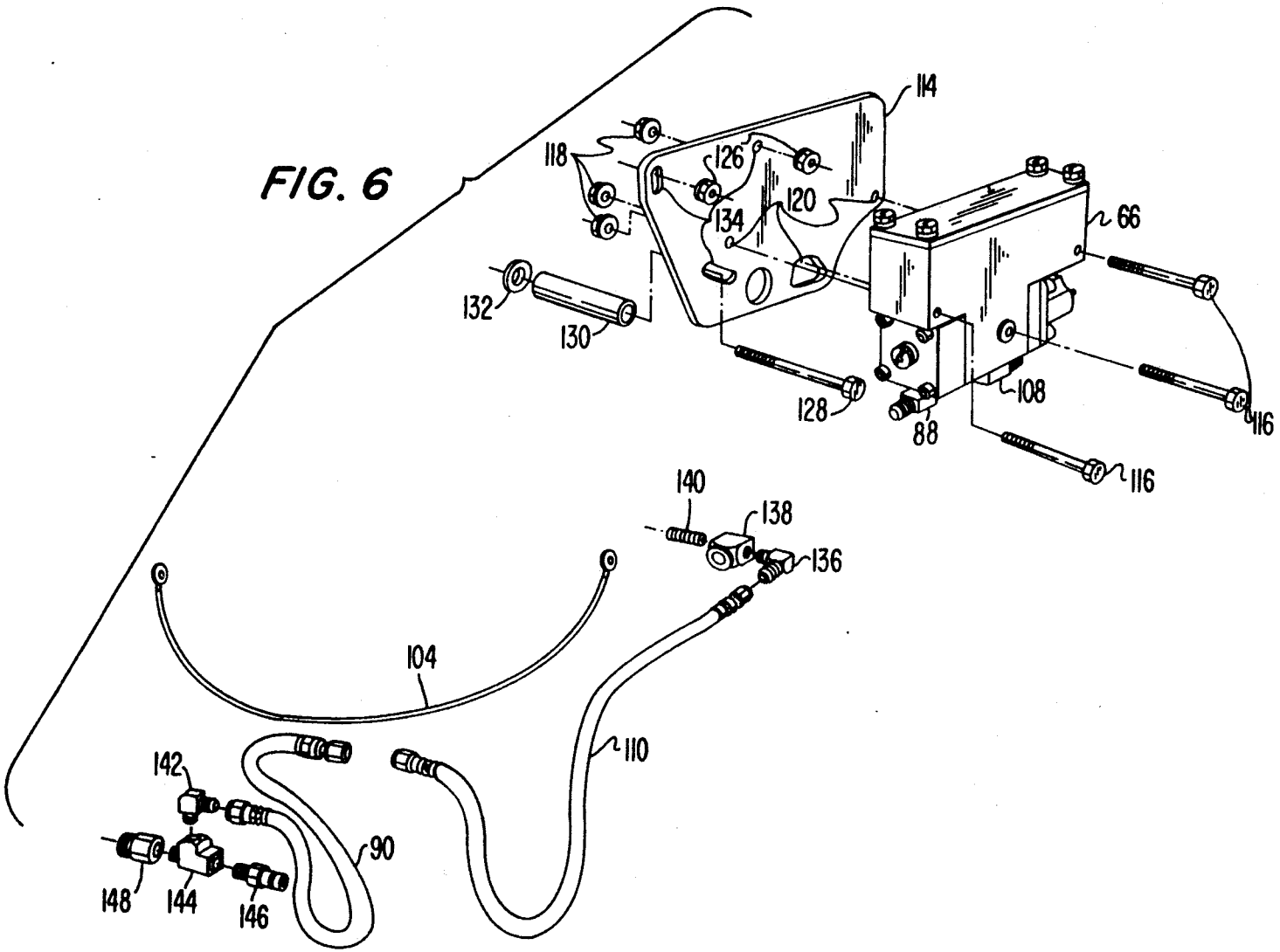
FIG. 6 is a exploded perspective view of the elements forming a hot start kit designed in accordance with the subject invention.

Referring now to FIG. 6, main housing 66 connects to mounting bracket 114 using housing mounting bolts 116 and housing mounting nuts 118 through an array of housing mounting holes 120 in the mounting bracket 114. The array of housing mounting holes 120 is internally symmetric to allow the main housing 66 to be mounted on either side of the mounting bracket 114.

Referring to FIGS. 6 and 8, mounting bracket 114 connects to the engine intake manifold using existing engine manifold bolt studs 124, on which bracket mounting nuts 126 are secured, and using bracket mounting bolt 128, spacer 130, and washer 132. The engine manifold bolt studs and the bracket mounting bolt 128 extend through bracket mounting holes 134 in mounting bracket 114. The array of bracket mounting holes 134 are internally symmetric (like housing mounting holes 120) to allow the mounting bracket 114 to be rotated 180 degrees and still be mounted using the existing engine manifold bolt studs 124.

Bracket mounting holes 134 and housing mounting holes 120 are offset from each other to allow the main housing 66 to be mounted in one of two alternate positions as will become more apparent hereinafter.

Fluid conduit 110 connects to common rail 32 using elbow 136, tee 138 and nipple 140. The opposite end of fluid conduit 110 connects to fitting 108 (FIG. 4) on the main housing 66. Fluid conduit 90 connects to fuel pump assembly (not shown) using elbow 142, tee 144, nipple 146 and adapter 148. The opposite end of fluid conduit 90 connects to L-shaped fitting 88 (FIG. 4). Electrical conductor 104 connects to solenoid 102 and an electrical control means such as the engine key start circuit (not illustrated).

Figure 7:
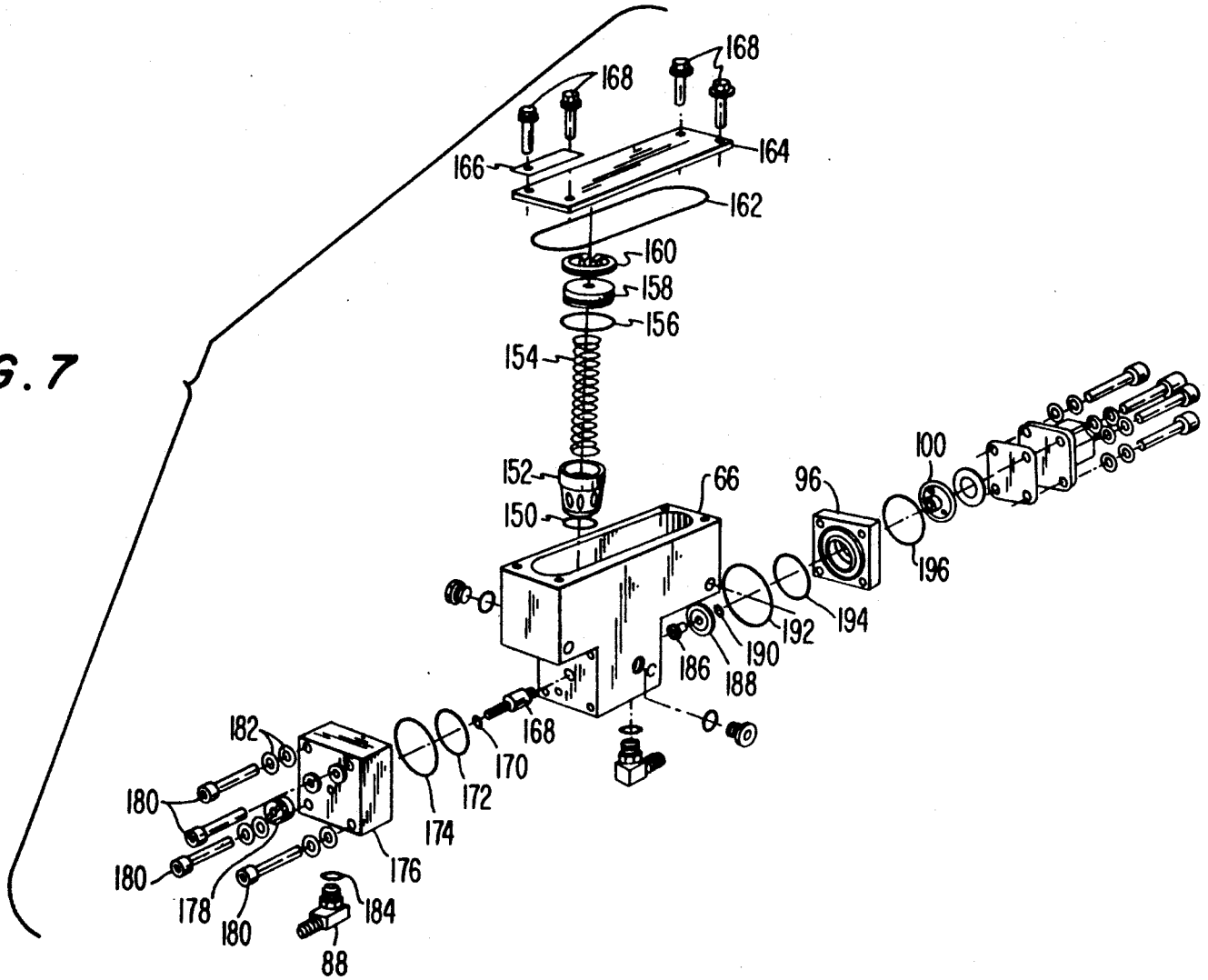
FIG. 7 is an exploded perspective view of the main housing and associated valves designed in accordance with the subject invention.

Referring now to FIG. 7, an exploded view of the fuel leakage prevention system 64 is shown. Check valve 72 is shown consisting of seal 150, plunger 152, spring 154, seal 156, retainer 158 and ring 160. Seal 162, cover plate 164, and name plate 166 are fastened to main housing 66 using bolts 168 as shown in FIG. 7. The manual shutoff valve assembly 78 is shown consisting of shaft 168, seals 170, 172 and 174, shutoff valve housing 176 and knob 178. Bolts 180 are used in conjunction with washers 182 to secure the manual shutoff valve assembly 78 to the main housing 66. L-shaped fitting 88 is connected to shutoff valve housing 176 with seal 184 as shown. Solenoid 102 is shown consisting of capscrew 186, disc 188, seals 190, 192, 194, and 196, actuator housing 96 and valve element assembly 100.

Referring now to FIG. 8, main housing 66 is shown attached to mounting bracket 114. Mounting bracket 114 is attached to the engine intake manifold 200 using existing engine manifold bolt studs 124, on which bracket mounting nuts 126 are secured. An alternative mounting configuration in which mounting bracket 114 is reversed, or rotated by 180 degrees, resulting in main housing 66 being mounted further forward in an axial direction to engine alignment is shown by dotted lines 204.

Referring now to FIG. 9, manual shut off valve assembly 78 is shown with L-shaped fitting 88 extending from the radial passage (not shown) in a downward direction. Additionally, alternative positions for L-shaped fitting 88 are shown by dotted lines 206. By the arrangement shown in FIG. 9, the geometry of the retrofitted hot start system may be adapted to fit the configuration and available space surrounding a pre-existing engine.

It should be understood that a variety of alternative arrangements could be provided in accordance with the subject invention. For example, a variety of different vacuum forming sources could be used such as a vacuum pump driven by the engine crankshaft. Also the manual shut off valve could be solenoid operated.

Industrial Applicability

The subject invention has utility in solving the problem of undesired fuel migration into the combustion chambers of an internal combustion engine upon engine shutdown. The invention has particular applicability to engines employing open nozzle, unit injectors operating on the pressure/time principle. The invention is especially applicable to vehicles equipped with diesel engines employing open nozzle, unit injectors operating on the pressure/time principle wherein the vehicle is frequently stopped and started and/or operates with low flash point fuels. Problems with injector carboning can also create situations wherein the subject invention would have special utility.

I claim:

1. A fuel leakage prevention system for eliminating undesired leakage of fuel into the combustion chambers of a multi-cylinder internal combustion engine from a plurality of corresponding fuel injectors supplied with fuel by a common rail connected to the fuel injectors, comprising a main housing containing an evacuatable chamber;

vacuum forming means fluidically connected with said evacuatable chamber and adapted to be fluidically connected with a source of sub-atmospheric pressure during engine operation;

vacuum applying means connected with said evacuatable chamber and adapted to be fluidically connected with the common rail, said vacuum applying means including a first valve means for fluidically connecting said evacuatable chamber to the common rail when operating in a first mode in response to a control signal and for fluidically isolating the common rail from said evacuatable chamber when operating in a second mode in response to a control signal; and control means for supplying said control signal to said first valve means to cause said first valve means to operate in said first mode during engine shut-down and to cause said first valve means to operate in said second mode during engine operation.

2. A fuel leakage prevention system as defined in claim 1, further including second valve means operatively connected with said vacuum forming means for isolating said evacuatable chamber from the source of sub-atmospheric pressure during engine shut-down.

3. A fuel leakage prevention system as defined in claim 2 for use with a fuel injection system including a fuel pump for supplying fuel at a controlled pressure to the common rail while creating a source of sub-atmospheric pressure, wherein said vacuum forming means includes a first fluid conduit fluidically connected at one end to said evacuatable chamber and adapted to be fluidically connected at the other end to the sub-atmospheric pressure forming portion of said fuel pump.

4. A fuel leakage prevention system as defined in claim 3, wherein said vacuum applying means including a second fluid conduit fluidically connected at one end to said evacuatable chamber and adapted to be fluidically connected at the other end to the common rail.

5. A fuel leakage prevention system as defined in claim 4, further including mounting hardware means for retrofitting the system on an existing internal combustion engine subject to performance problems associated with undesired fuel leakage into the combustion chambers.

6. A fuel leakage prevention system as defined in claim 5, further including adaptor fittings for connecting said first and second fluid conduits to the sub-atmospheric fluid pressure portion of the fuel pump and the common rail, respectively.

7. A fuel leakage prevention system as defined in claim 6, further including instructions for retrofitting the system to preexisting internal combustion engines and packaging for combining said instructions with the remaining elements of the system for shipment to retrofitting installers.

8. A fuel leakage prevention system as defined in claim 5 for use with an engine having an intake manifold with a preexisting array of bolt holes, wherein said hardware means includes a mounting bracket having a first array of mounting holes corresponding to the preexisting array of intake manifold bolt holes.

9. A fuel leakage prevention system as defined in claim 8, wherein said mounting bracket includes a second array of holes for receiving fasteners for mounting said main housing on said bracket and wherein said first and second arrays are offset and each said array is internally symmetrical to allow said bracket to be mounted on the engine intake manifold in one of two reversed positions to allow said main housing to be mounted in one of two offset positions using the said bracket.

10. A fuel leakage prevention system as defined in claim 2, wherein said second valve means includes a check valve for responding to pressure differences within said evacuatable chamber and the sub-atmospheric source to disconnect fluidically said evacuatable chamber from the sub-atmospheric source when the pressure within said evacuatable chamber falls below the pressure of the sub-atmospheric source.

11. A fuel leakage prevention system as defined by claim 1, wherein said first valve means includes a solenoid operator for converting said first valve means from said first mode to said second mode in response to electrical energization and spring bias means for returning said valve means to said second mode in response to loss of electrical energization.

12. A fuel leakage prevention system as defined by claim 1, wherein said main housing includes a vacuum port fluidically connected with the source of sub-atmospheric pressure and wherein said vacuum forming means includes a shutoff valve means for shutting off the fluid connection between said evacuatable chamber and the source of sub-atmospheric pressure, said shutoff valve means including a shutoff valve housing adapted to be mounted on said main housing in one of plural rotationally displaced positions about the central axis of said vacuum port, said shutoff valve housing including an internal passage connected at one end with said vacuum port and connected with a side port located radially from the rotational axis of said shutoff valve housing.

13. A fuel leakage prevention system as defined by claim 10, wherein said vacuum forming means includes a first conduit connected at one end to said side port and adapted to be connected at the other end to the source of sub-atmospheric pressure, whereby the directional orientation of said first conduit relative to said main housing may be changed by changing the rotational position in which said shutoff housing is mounted on said main housing.

14. A fuel leakage prevention system as defined by claim 12, wherein said shutoff valve means includes a manual operator for permitting manual shutoff of the fluid connection between said evacuatable chamber and the source of sub-atmospheric pressure.

15. A fuel injection system for injecting fuel periodically into the combustion chambers of a multi-cylinder internal combustion engine, comprising fuel pump means for forming a source of fuel under pressure;

a common rail for supplying fuel under pressure from said fuel pump means to each of the engine cylinders during engine operation;

a plurality of fuel injectors connected with said common rail for injecting fuel from said common rail into corresponding cylinders of the engine, each said fuel injector including an injection orifice from which fuel enters into the corresponding engine cylinder from said fuel injector on a periodic basis during engine operation, at least one of the engine combustion cylinders remaining fluidically connected with said common rail during engine shut down through a corresponding open injection orifice; and vacuum applying means for preventing migration of fuel into the engine cylinders through said injection orifices during engine shut down by reducing the fluidic pressure within said common rail sufficiently to prevent fuel from migrating through said open injection orifices.

16. A fuel injection system as defined in claim 15, further including a main housing containing an evacuatable chamber; and vacuum forming means fluidically connected with said evacuatable chamber and adapted to be fluidically connected with a source of sub-atmospheric pressure during engine operation; and wherein said vacuum applying means is connected with said evacuatable chamber and adapted to be fluidically connected with said common rail, said vacuum applying means including a first valve means for fluidically connecting said evacuatable chamber to the common rail when operating in a first mode in response to a control signal and for fluidically isolating the common rail from said evacuatable chamber when operating in a second mode in response to a control signal; and further including control means for supplying said control signal to said first valve means to cause said first valve means to operate in said first mode during engine shut-down and to cause said first valve means to operate in said second mode during engine operation.

17. A fuel injection system as defined in claim 16, further including second valve means operatively connected with said vacuum forming means for isolating said evacuatable chamber from the source of sub-atmospheric pressure during engine shut-down.

18. A fuel injection system as defined in claim 17, wherein said fuel pump means creates a source of sub-atmospheric pressure, and wherein said vacuum forming means includes a first fluid conduit fluidically connected at one end to said evacuatable chamber and adapted to be fluidically connected at the other end to the sub-atmospheric pressure created by said fuel pump means.

19. A fuel injection system as defined in claim 18, wherein said vacuum applying means including a second fluid conduit fluidically connected at one end to said evacuatable chamber and adapted to be fluidically connected at the other end to the common rail.

20. A fuel injection system as defined in claim 17, wherein said second valve means includes a check valve for responding to pressure differences within said evacuatable chamber and the sub-atmospheric source to disconnect fluidically said evacuatable chamber from the sub-atmospheric source when the pressure within said evacuatable chamber falls below the pressure of the sub-atmospheric source.

21. A fuel injection system as defined by claim 16, wherein said first valve means includes a solenoid operator for converting said first valve means from said second mode to said first mode in response to electrical energization and spring bias means for returning said valve means to said second mode in response to loss of electrical energization.

22. A fuel injection system as defined by claim 16, wherein said main housing includes a vacuum port fluidically connected with the source of sub-atmospheric pressure and wherein said vacuum forming means includes a shutoff valve means for shutting off the fluid connection between said evacuatable chamber and the source of sub-atmospheric pressure, said shutoff valve means including a shutoff valve housing adapted to be mounted on said main housing in one of plural rotationally displaced positions about the central axis of said vacuum port, said shutoff valve housing including an internal passage connected at one end with said vacuum port and connected with a side port located radially from the rotational axis of said shutoff valve housing.

23. A fuel injection system for injecting fuel periodically into a combustion chamber of an internal combustion engine, comprising fuel injector having a body containing at least one injection orifice and an injection chamber into which fuel may be metered and from which the metered fuel may be expelled for periodic injection into the combustion chamber of the internal combustion engine through said injection orifice;

vacuum forming means for forming a sub-atmospheric pressure; and vacuum applying means for preventing migration of the supplied fuel from said injection chamber into the combustion chamber during shut down of the internal combustion engine by fluidically connecting said vacuum forming means with said injection chamber during engine shut-down.

24. A fuel injection system as defined in claim 23, wherein said body contains a central bore and wherein said injector includes a cam operated, injector plunger mounted for reciprocating movement within said central bore to form said injection chamber, said injection orifice being positioned adjacent one end of said central bore such that said injection orifice remains open to said corresponding injection chamber when said injector plunger is displaced from said one end of said central bore.

25. A fuel injection system as defined in claim 24, further including a common rail for supplying fuel to said fuel injector, said injector plunger causing said injection chamber to be fluidically connected with said injection orifice and the corresponding combustion chamber whenever said injector plunger is retracted at least a predetermined distance from said open injection orifice.

26. A fuel injection system as defined in claim 25, further including a main housing containing an evacuatable chamber; and vacuum forming means fluidically connected with said evacuatable chamber and adapted to be fluidically connected with a source of sub-atmospheric pressure during engine operation; and wherein said vacuum applying means connected with said evacuatable chamber and fluidically connected with said common rail, said vacuum applying means including a first valve means for fluidically connecting said evacuatable chamber to the common rail when operating in a first mode in response to a control signal and for fluidically isolating the common rail from said evacuatable chamber when operating in a second mode in response to a control signal; and control means for supplying said control signal to said first valve means to cause said first valve means to operate in said first mode during engine shut-down and to cause said first valve means to operate in said second mode during engine operation.

27. A fuel injection system as defined in claim 26, further including second valve means operatively connected with said vacuum forming means for isolating said evacuatable chamber from the source of sub-atmospheric pressure during engine shut-down.

28. A fuel injection system as defined in claim 27, further including a fuel pump for supplying fuel at a controlled pressure to said common rail while creating a source of sub-atmospheric pressure, wherein said vacuum forming means includes a first fluid conduit fluidically connected at one end to said evacuatable housing and fluidically connected at the other end to the sub-atmospheric pressure within the fuel injection system.

29. A fuel injection system as defined in claim 28, wherein said vacuum applying means includes a second fluid conduit fluidically connected at one end to said evacuatable chamber and adapted to be fluidically at the other end to the common rail.

* * * * *